United States Patent [19]

Tsukamoto et al.

[11] 4,144,856

[45] Mar. 20, 1979

[54] EXHAUST GAS RECIRCULATION SYSTEM

[75] Inventors: Yutaka Tsukamoto, Johyoh; Tatsuro Nakagami, Kyoto, both of Japan

[73] Assignee: Mitsubishi Jidosha Kogyo Kabushiki Kaisha, Tokyo, Japan

[21] Appl. No.: 804,852

[22] Filed: Jun. 8, 1977

[30] Foreign Application Priority Data

Nov. 25, 1976 [JP] Japan ..... 51-141602

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,954,091 | 5/1976 | Stumpp | 123/119 A |
| 4,024,847 | 5/1977 | Koganemaru | 123/119 A |
| 4,041,913 | 8/1977 | Nohira | 123/119 A |
| 4,061,119 | 12/1977 | Takeshita | 123/119 A |

*Primary Examiner*—Carlton R. Croyle
*Assistant Examiner*—Michael Koczo, Jr.
*Attorney, Agent, or Firm*—Fidelman, Wolffe & Waldron

[57] ABSTRACT

An exhaust gas recirculation system comprising an exhaust gas recirculation passage means between an exhaust gas passage and an intake passage, first and second flow control valves provided in the recirculation passage means in parallel relationship with each other for regulating flows of the exhaust gas in response to two kinds of vacuum having different characeristics, and a third flow control valve provided in the recirculation passage means in series with said first and second valves for regulating a flow of the gas in response to opening of a throttle valve of a carburetor, thereby obtaining the appropriate amount of exhaust gas recirculation in light and medium loaded driving ranges.

2 Claims, 5 Drawing Figures

SLOW SPEED RANGE

EXHAUST GAS RECIRCULATION SYSTEM

BACKGROUND OF THE INVENTION

This invention relates to an exhaust gas recirculation system in an exhaust gas purifying system for use in an internal combustion engine such as an engine for a motor vehicle.

The exhaust gas recirculation system is adapted to return a portion of exhaust gas in an exhaust system to an intake passage to increase an amount of incombustible components in an intake gas. Combustion temperature in a cylinder is restrained by the increase of incombustibles, thereby reducing generation of nitrogen oxide ($NO_x$).

However, a characteristic of generation of $NO_x$ varies depending on driving conditions of the engine. In case of the vehicle engine, generation of $NO_x$ is high in a high loaded range of the engine, such as at a time of acceleration, but it is appreciable in a light loaded range such as constant driving and idling of the engine.

Further, if a large amount of the exhaust gas is unnecessarily recirculated during the light loaded driving, deterioration of drivability and instability of running of the engine are resulted due to a drop of combustion output. With a view to this, in operation of the exhaust gas recirculation system, it is required to recirculate an appropriate amount of exhaust gas depending on driving conditions of the engine.

To meet said requirement, in the conventional exhaust gas recirculation system, there has been adopted generally such a way that a flow control valve is provided in a recirculation passage and operated by use of an element, such as vacuum produced at an intake system, which is variable depending on the driving conditions of the engine. Also, various methods of controlling operation of the valve have been utilized and proposed to suit the amount of exhaust gas recirculation for any output range of the engine. However, since the more severe value of regulation of $NO_x$ is required in these days, the amount of exhaust gas recirculation tends to be increased. Consequently, it is difficult to control the amount of the recirculation in the light loaded range with the conventional exhaust gas recirculation technics, and the deterioration of drivability may be realized at a low output of the engine.

SUMMARY OF THE INVENTION

An object of this invention is to provide an exhaust gas recirculation system in which the appropriate amount of the exhaust gas recirculation can be obtained in the light loaded range of the engine.

According to this invention, there is provided an exhaust gas recirculation system for an engine, comprising an exhaust gas recirculation passage means provided between a point in an exhaust gas passage in an exhaust system and an intake passage of the engine so as to lead a portion of the exhaust gas to the intake passage through the recirculation passage means, first and second vacuum-operated flow control valves provided in the recirculation passage means in a parallel relationship with each other, and a third mechanically-operated flow control valve provided in the recirculation passage in series with said first and second control valves, said first and second control valves being applied respectively with two kinds of vacuum which are produced in the intake passage of a carburetor and have different characteristics, each of said first and second valves being responsive to a level of the corresponding vacuum to open its valve passage, said third control valve being responsive to opening of a throttle valve of the carburetor to open its valve passage.

BRIEF DESCRIPTION OF THE DRAWINGS

This invention will be explained by way of example with reference to the accompanying drawings in which.

DESCRIPTION OF THE PREFERRED EMBODIMENTS

Figure 1:
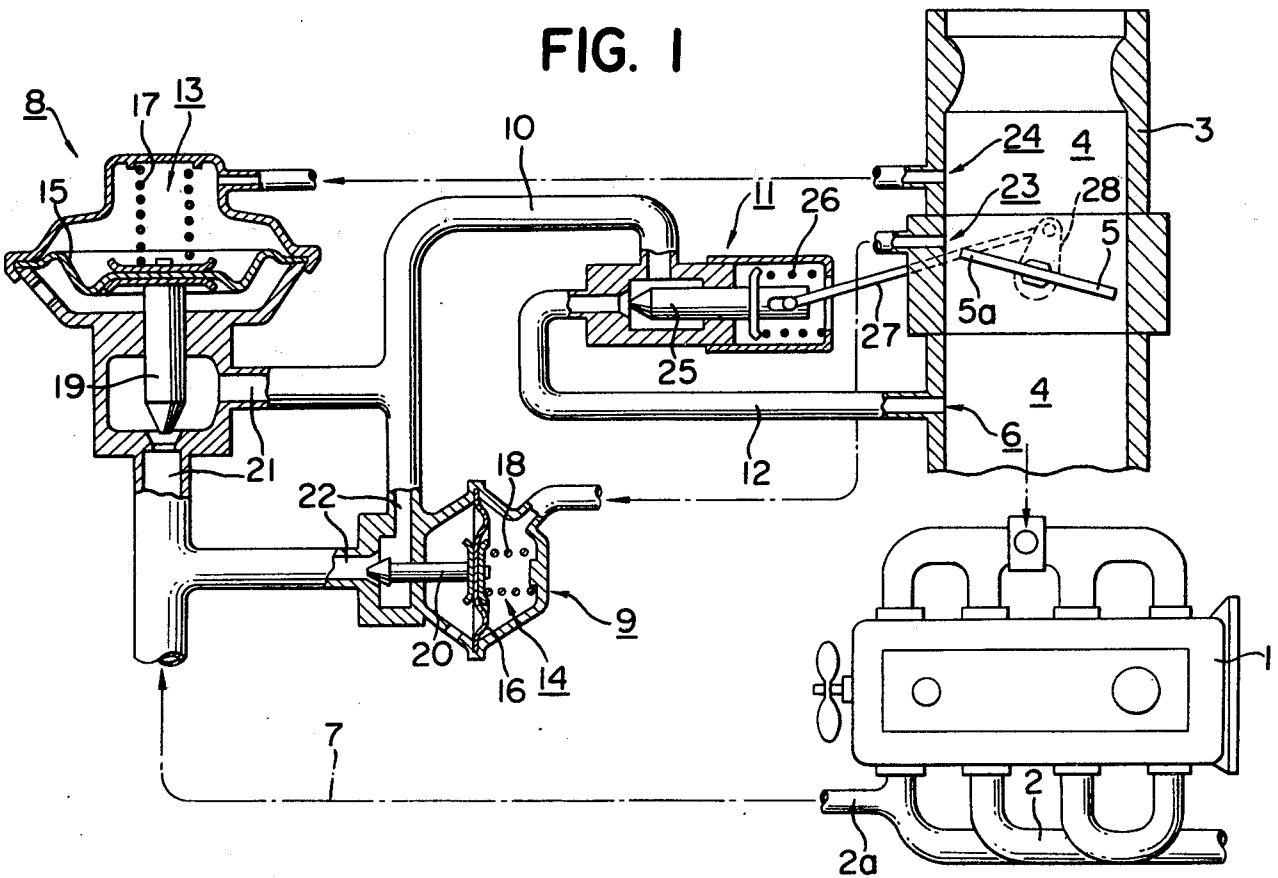
FIG. 1 is a schematic illustration of an exhaust gas recirculation system according to the invention, partially shown in cross-section.

Referring to FIG. 1, the exhaust gas recirculation system for the internal combustion engine 1 is adapted to lead a portion of exhaust gas from a branch 2*a* provided in an exhaust manifold 2 of the engine 1 to a manifold aperture 6 in an intake passage 4. The aperture 6 is located in the passage 4 adjacent to a carburetor 3 and downstream of a throttle valve 5 thereof. The recirculation system comprises a recirculation passage 7, a first flow control valve 8, a second flow control valve 9 disposed parallel thereto, a recirculation passage 10, a third flow control valve 11 and a recirculation passage 12, through which exhaust gas is sucked into the intake passage 4 by a vacuum produced therein.

The first and second control valves 8 and 9 have vacuum chambers 13 and 14 for operating the valves, respectively. Each vacuum chamber 13 or 14 is defined by a diaphragm 15 or 16 and contains a pressure differential balancing spring 17 or 18. The side of each diaphragm opposite to the vacuum chamber is exposed to atmosphere. Needle valves 19 and 20 are connected to the diaphragms 15 and 16 and adapted to control opening of a main flow passage 21 and a bypass flow passage 22, respectively.

In an inner wall of the intake passage 4, a vacuum port 23 is provided at a point upstream of and adjacent to an end 5*a* of the throttle valve 5 which is in its closed or idle-open position, and another vacuum port 24 is provided appreciably upstream of said point. The ports 23 and 24 are communicated to the vacuum chamber 14 of the second valve and the vacuum chamber 13 of the first valve through vacuum conduits, respectively.

The ports 23 and 24 are located so as to oppose to the end 5*a* of the throttle valve 5 when angles of opening of the throttle valve 5 is about 10° and 20°, respectively.

The third flow control valve 11 is a mechanically actuated valve. The valve 11 has a needle valve 25 which is urged toward its closed position by a compression spring 26. The needle valve 25 is connected to the throttle valve 5 by means of a link 27, one end of which is pivoted to the right end of the needle valve in FIG. 1, and a lever 28 connected to the other end of the link 27. Thus, the needle valve 25 is displaced in response to movement of the throttle valve 5 to regulate a flow rate of the exhaust gas.

The operation of the exhaust gas recirculation system constructed as described above is explained.

Figure 2:
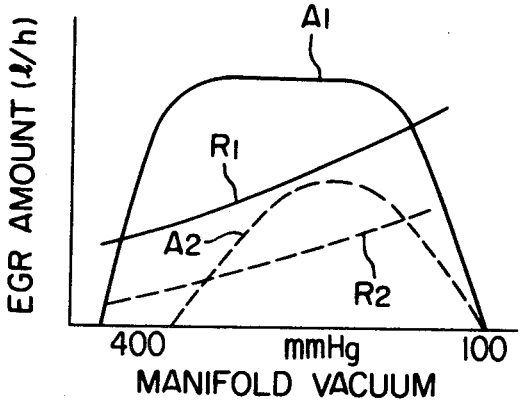
FIG. 2 is a diagram showing an operational characteristic of a vacuum operated valve used in the system.

Firstly, a flow characteristic of the first control valve 8 as a main valve operated by the vacuum at the port 24 is explained. The characteristic of the vacuum at the port 24 is such that the vacuum is not substantially produced at the idle-open position and the full throttle position of the throttle valve 5, but is high at the medium open position of the throttle valve. Correspondingly, the characteristic of the first control valve 8 is such that a flow rate of the recirculated exhaust gas (EGR amount) is high in a medium range of a manifold vacuum (medium loaded range of the engine), but is low in ranges above and below said medium range (high and light loaded ranges), as indicated by a characteristic curve $A_1$ in a medium speed range and a characteristic curve $A_2$ in a slow speed range, as shown in FIG. 2. This flow rate or EGR amount is excessive in the medium vacuum range and is too low in the ranges other than said medium range, comparing with a desired flow rate of the exhaust gas for adapting itself to a characteristic of generation of $NO_x$ (characteristic curve $R_1$ in the medium speed range and characteristic curve $R_2$ in the slow speed range).

The object of the second and third control valves 9 and 11 are to compensate said inadaptabilities in the slow and medium speed ranges. That is, the second bypass flow control valve 9 is actuated by the vacuum at the port 23, which has a characteristic that it is high in the light loaded range, and operates to sufficiently open the bypass passage 22 so as to supplement said insufficient flow of the exhaust gas by the exhaust gas flow through the passage 22. The excessive flow of the exhaust gas in the medium loaded range is limited by the third control valve 11 which opens in response to an open movement of the throttle valve 5.

Figure 3:
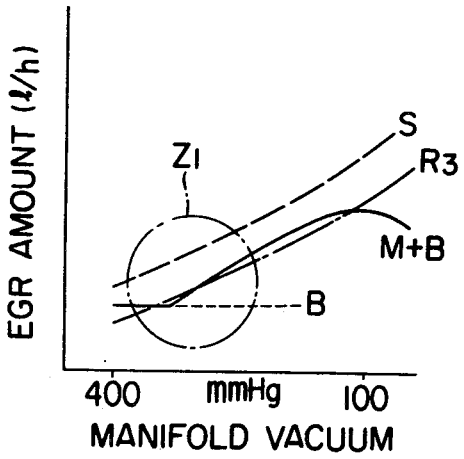
FIG. 3 is a diagram showing an operational characteristic of the system at a slow speed range.
Figure 4:
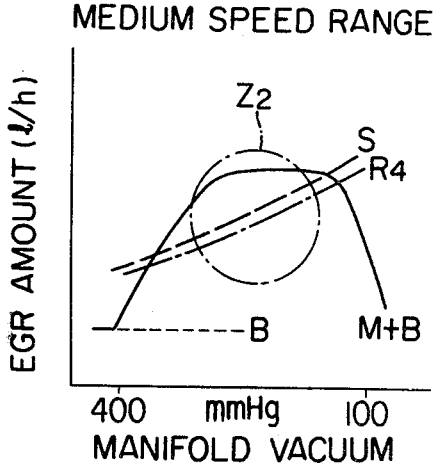
FIG. 4 is a diagram showing an operational characteristic of the system at a medium speed range.

At the light loaded range $Z_1$ in the slow speed range, in which driving range and frequent driving is carried out, a sum of the main gas flow rate M through the valve 8 and the bypass gas flow rate B through the valve 9 substantially corresponds to the required flow rate $R_3$, as shown in a characteristic curve M + B in FIG. 3. Also, at the medium loaded range $Z_2$ in the medium speed range, in which driving range the frequent driving is carried out, the gas flow rate S limited by the third control valve 11 substantially corresponds to the required flow rate $R_4$, as shown in a characteristic curve S in FIG. 4.

Figure 5:
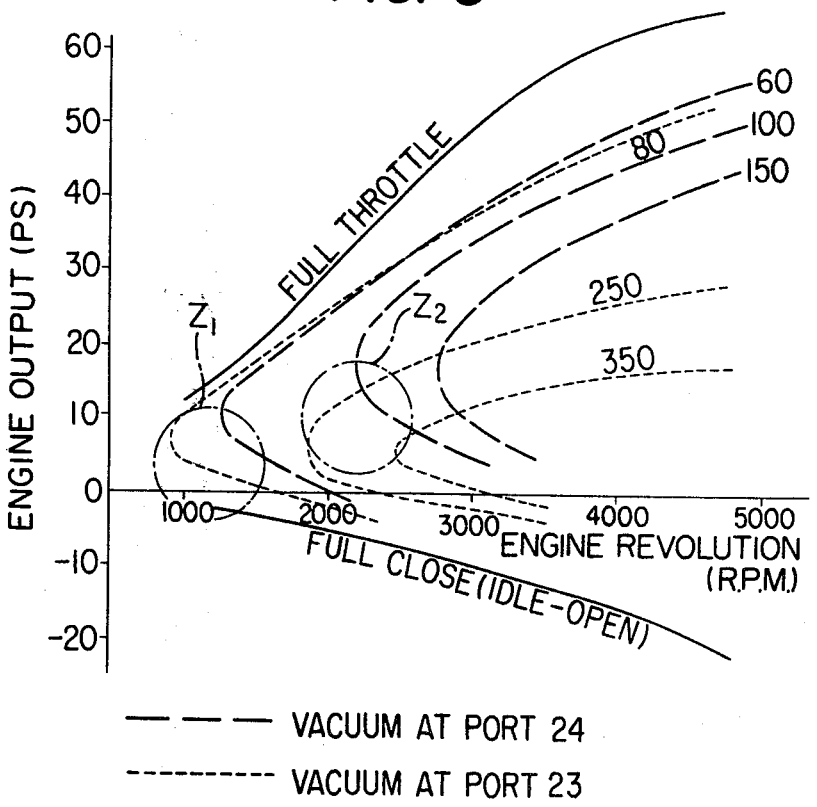
FIG. 5 is a diagram showing an output characteristic of the engine provided with the system according to the invention.

Recirculated operation of the exhaust gas recirculation system as described above is indicated by output curves in FIG. 5. In the light loaded range $Z_1$, the recirculation of the exhaust gas is performed by the effect of the vacuum of a high level produced at the port 23 (short dotted line). The recirculation is taken place by the effects of the vacuum at the port 23 and the vacuum produced at the port 24 (long dotted line) in the medium loaded range $Z_2$. Thus, the exhaust gas recirculation is controlled appropriately in the light and medium loaded ranges, particularly in the light loaded range in which control of the recirculation is difficult in the conventional exhaust gas recirculation system.

As described above, the exhaust gas recirculation system according to the invention is provided in the recirculation passage of the exhaust gas with the bypass flow control valve 9 operated by the vacuum at the port 23 and the flow control valve 11 interlocked with the throttle valve, whereby the insufficient gas flow in the recirculating operation by the vacuum at the port 24 is compensated. Therefore, the appropriate recirculation of the exhaust gas is obtained during the light loaded driving of the engine, so that drivability of the vehicle equipped with the system is improved, as well as $NO_x$ is effectively reduced at the light loaded driving.

What is claimed is:

1. An exhaust gas recirculation system for an internal combustion engine including at least one exhaust gas passage therefrom and at least one throttle valve containing intake passage thereto, comprising an exhaust gas recirculation passage means communicating between said exhaust gas passage and said intake passage of the engine to lead a portion of the exhaust gas to said intake passage, first and second vacuum-operated flow control valves in the recirculation passage means in a parallel relationship with each other, a third flow control valve in the recirculation passage means in series with said first and second control valves said third control valve being mechanically linked to said throttle valve in said intake passage of the engine to open in response to opening of said throttle valve, and multiple ports in the inner wall of said intake passage, one port positioned at a point adjacent to one end of said throttle valve in its closed position communicating with said second control valve and providing vacuum for the operation thereof, another port positioned upstream of said throttle valve in its closed position communicating with said first control valve, and providing vacuum for the operation thereof.

2. An exhaust gas recirculation system according to claim 1, wherein said third control valve is downstream of said first and second control valves.

* * * * *